US005172444A

United States Patent [19]

Penet

[11] Patent Number: 5,172,444

[45] Date of Patent: Dec. 22, 1992

[54] JIG

[76] Inventor: Charles M. A. Penet, 64 Avenue de la Republique, 95400 Arnouville, France

[21] Appl. No.: 732,119

[22] Filed: Jul. 18, 1991

Related U.S. Application Data

[63] Continuation-in-part of Ser. No. 444,128, Nov. 15, 1989, abandoned.

[30] Foreign Application Priority Data

May 15, 1987 [FR] France ..... 87 6825

[51] Int. Cl.[5] ..... D06B 3/32; B65H 59/38

[52] U.S. Cl. ..... 8/151; 68/13 R; 68/180; 242/67.4; 242/75.51

[58] Field of Search ..... 8/151; 68/13 R, 175, 68/180; 242/67.4, 75.51, 75.52

[56] References Cited

U.S. PATENT DOCUMENTS

| | | | |
|---|---|---|---|
| 1,848,663 | 3/1932 | Robinson, Jr. | 242/67.4 |
| 1,869,900 | 8/1932 | Landenberger | 68/180 X |
| 2,108,313 | 2/1938 | Horter | 242/67.4 |
| 3,411,055 | 11/1968 | Carter, II et al. | 242/75.51 X |
| 3,648,338 | 3/1972 | Mruk | 242/75.51 X |
| 3,910,521 | 10/1975 | O'Callaghan et al. | 242/75.51 |
| 4,166,590 | 9/1979 | Dennhardt | 242/75.51 |
| 4,172,231 | 10/1979 | d'Alayer de Costemore d'Arc et al. | 242/75.51 X |
| 4,461,433 | 7/1984 | Kani | 242/75.51 |

*Primary Examiner*—Philip R. Coe
*Attorney, Agent, or Firm*—Breiner & Breiner

[57] ABSTRACT

Method for operating a machine intended for dyeing textile webs wherein the fabric to be dyed is passed through a dyeing bath and is wound onto a tractive roller. The instantaneous angular speed of the tractive roller is controlled during the operation of the machine and the speed regulated so as to maintain constant or substantially constant the centrifugal acceleration at the point where the fabric winds onto the tractive roller. Application is to machines of the Jig type.

16 Claims, 2 Drawing Sheets

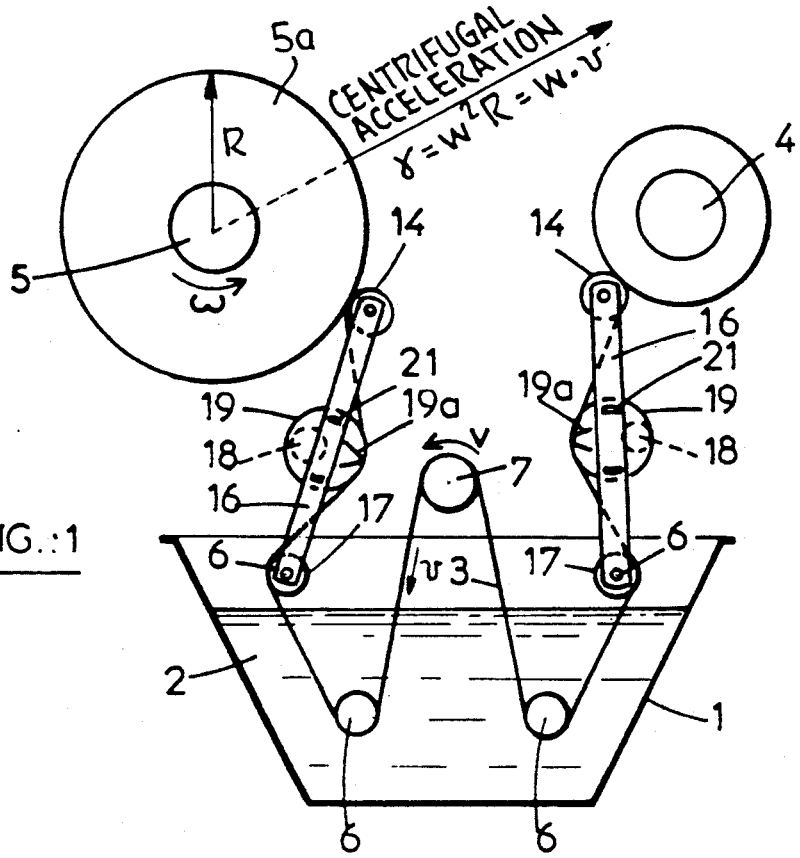
FIG.: 1
FIG.: 3
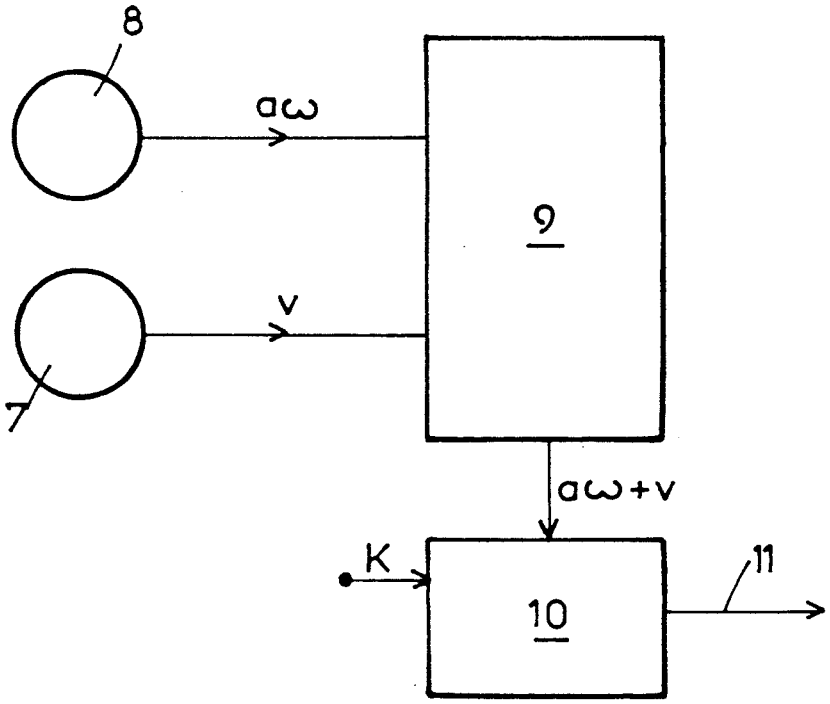

JIG

RELATED APPLICATION

The present application is a continuation-in-part of U.S. Ser. No. 07/444,128 filed Nov. 15, 1989, and now abandoned entitled "Jig".

FIELD OF THE INVENTION

The present invention relates to dyeing machines possessing two rollers, onto which the fabric to be dyed is wound.

The fabric is transferred from one roller to the other, at the same time passing through the dyeing bath, and is thereby impregnated with a dye which is gradually fixed to the fiber.

BACKGROUND OF THE INVENTION

Machines of this type are known as jigs.

The manufacturers of these machines have often attempted to make the fabric travel at a constant linear speed on its way through the bath (see FR-A-1, 525,192).

The applicant considered that this constant linear speed could be harmful, being the cause of the lack of uniformity of dyeing which is sometimes seen on webs of fabric of a particular length. In fact, the radius of the winding roll which is formed at each moment by the roller itself and by the fabric already wound varies greatly during the passage of the fabric, for example often being from 1 to 3; moreover, the centrifugal acceleration $\gamma$ to which the fabric is subjected at the moment when it winds on, varies in the same ratio, but inversely, that is to say from 3 to 1, when the speed is constant, according to the mathematic relations: $Y=\omega^2R=\omega v=v^2/R$ wherein $\gamma$ is the centrifugal acceleration, $\omega$ is the angular speed of the winding roller, R is, at each moment, the radius of the whole consisting of the roller and of the fabric wound on it, and v is the linear (or tangential) speed of the fabric given by the relation $v=\omega R$.

The quantity of bath and consequently of dye retained by the fabric therefore varies appreciably, and this can give rise to the defect mentioned above.

OBJECTS AND BRIEF DESCRIPTION OF THE INVENTION

The object of the present invention is to obtain, on the wound fabric, after it has passed through the bath, substantially constant uptake rate (percentage of bath contained in the fabric) from one end of the fabric to the other.

According to the invention, there is no longer any attempt to keep the linear speed of the fabric constant, but means are provided for controlling and keeping constant the centrifugal acceleration, to which the fabric, and the bath which it contains, is subjected at the moment when it winds onto the draw roller.

Not only is a limit set on this acceleration, but also it is made constant or virtually constant from one end of the fabric to the other. For example, assuming that the roller is driven by a direct-current motor, it is possible to servo-control electronically the angular speed of said motor by the centrifugal acceleration $\gamma=\omega v$ on the outer surface of the fabric wound on said roller, which requires measuring permanently the values of $\omega$ and v.

Tachometric dynamos can be used to this end:

Two dynamos fixed respectively to the motors coupled to the rollers provide, in turn, a signal proportional to the angular speed $\omega$ of that roller which is the draw (winding) roller.

A third dynamo, driven by a free roller actuated tangentially by the fabric, gives a signal proportional to the linear speed v of the latter.

These signals in the form of voltages are reduced to compatible values in relation to the measured units (radians and meters per second), so that their product gives $\gamma=\omega.v$.

This product is obtained electronically and compared with an order value in an electronic device acting on a variator of the speed of the motor, so that the measured product remains equal to the order value of the acceleration.

For example, the motor can be a direct-current electric motor which receives an electromotive voltage adjustable by means of a thyristor-type variator.

As an alternative, if variable-speed hydraulic transmission is used for driving each roller by its electric motor, the ratio of the angular speeds at the input and at the output of the transmission can also be controlled as a function of the measurement of the product $\omega.v$.

In another embodiment of the invention, the angular speed $\omega$ of the winding roller and the number n of wound turns at each moment are detected, respectively, by a tachometric dynamo, and by a counter, and the angular speed $\omega$ of the winding roller is adjusted in order to keep the expression $$\omega^2\left(1+n\frac{m-1}{N}\right),$$

constant, m being the ratio of the final radius of the winding roller to its initial radius, and N being the number of wound turns of the fabric at the end of winding. As explained hereunder, the said expression results from a mathematical calculation taking account of the said number n and of thickness of the fabric.

In another embodiment, the sum $a\omega+v$ is taken as the function to be kept constant, instead of the product $\omega.v$, a being a constant coefficient determined so that the centrifugal acceleration is the same for the two extreme values of the radius R. In fact, in this case, the calculation shows that the variation of the acceleration within the interval is only slight.

It was found by calculation that the coefficient a is preferably equal to $R_1\sqrt{m}$, $R_1$ being the initial radius of the roller, and m being the ratio of the maximum radius to the initial radius. For the common ratio of 3 mentioned above, $$a=R_1\sqrt{3}.$$

The sum of the signals $a.\omega$ and v given by the tachometric dynamos, and the comparison with the order value of this sum can be carried out in simple electronic circuits.

Another improvement which is likewise the subject of the invention and which has the same objective, namely to obtain a uniform uptake rate over the entire surface of the fabric, relates to the small cylinders which guide the fabric at the point of winding onto (and unwinding from) the winding rollers. These small cylinders bear on the fabric to a greater or lesser extent. They are each mounted on two articulated arms, so that they follow the variation in the diameter of the rollers. Now it happens that, either as a result of the wear of the bearings or because of a poor alignment of the joints, the bearing of these cylinders on their associated rollers is no longer equal from one edge of the fabric to the other. This results in a varying drying and in color gradation from one edge to the other.

To overcome this disadvantage, according to the invention the oscillating frame formed by the two above-mentioned arms is made deformable, in such a way that, as a result of the action of the fabric itself or of the weight of the assembly as a whole or of springs or of the three actions combined, the small cylinder seeks to bear over the entire breadth of the fabric, the slight drying thus becoming uniform.

The following description with reference to the accompanying drawing given by way of non-limiting example will make it easy to understand how the invention can be put into practice, the particular features emerging both from the text and from the drawing of course forming part of the said invention.

BRIEF DESCRIPTION OF DRAWINGS

FIG. 1 is a diagrammatic view of a dyeing machine of the jig type.

FIG. 3 shows diagrammatically another embodiment of a regulating system according to the invention.

DESCRIPTION OF THE PRESENTLY PREFERRED EMBODIMENT

Figure 2:
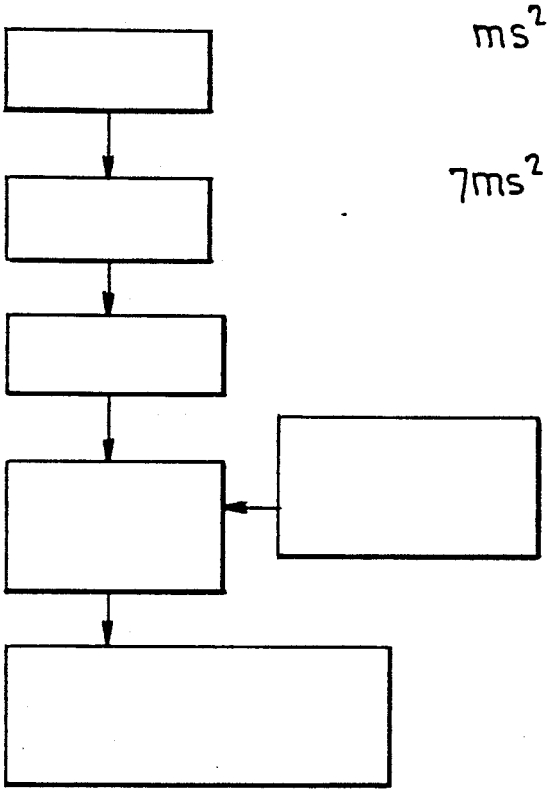
FIG. 2 is a diagram illustrating one embodiment of the invention.

The machine illustrated in FIG. 1 comprises a vat 1 which is filled with the dyeing bath 2 and through which the web of fabric 3 to be dyed passes, this web unwinding from a roller 4 and then winding onto a roller 5. The latter is the draw roller and it is driven in rotation by an electric motor not shown. At each moment the radius R to be considered, in the expression of the centrifugal acceleration $\gamma$ sustained by the fabric at its laying on the roll, is the sum of the radius of the rigid core of the roller and of the total thickness of the fabric 5*a* already wound. Therefore, this radius R increases during the operation.

According to an embodiment of the invention, the electric motor is of the kind wherein the angular speed of rotation $\omega$ may be adjusted electronically. Motors of this kind are well known at the present time. For instance, the motor can be a direct-current motor which receives an electromotive voltage adjusted by a conventional thyristor-type variator.

A variable-speed hydraulic transmission can also be used for driving the roller from the electric motor.

The web of fabric, on its way from one roller to the other, is guided so as to pass over small cylinders 6 mounted loosely on their axles. It also passes over an intermediate cylinder 7 which is located above the dyeing bath and which it drives in rotation at the same time as a tachometric dynamo connected to this cylinder 7. This dynamo generates a signal proportional to the tangential speed of the roller 7 and consequently to the linear speed of movement of the fabric, symbolized by v.

Another tachometric dynamo linked to the movement of the roller 5 gives an image of the angular speed $\omega$ of this roller. The product v.$\omega$ which is an image of the centrifugal acceleration can thus be obtained, provided that the rough values are reduced to compatible and uniform values, this being possible by means of simple divider bridges.

By transmitting this image v.$\omega$, as a measurement in relation to an order value K applied to an electronic comparator, the output of the latter produces a voltage which can be used for controlling the speed of the drive motor of the roller. This motor can be a direct-current motor fed by a conventional thyristor-type variator as indicated above.

The program is indicated diagrammatically in FIG. 2 and can be put into effect by any electronics engineer.

Another alternative embodiment stems from the following considerations:

let m be the ratio $R_m/R_o$ $R_o$ being the radius of the winding roller at the start of winding, and $R_m$ being its radius at the end of winding. This ratio is given directly by a comparison of the speeds $\omega_1$ and $\omega_1$ of the two rollers of the jig at the end of the winding: $\omega_1 R_m = \omega_2 R_o$, hence $R_m/R_o = \omega_2/\omega_1$ Let N be the number of wound turns of the fabric at the end of winding. This number is given at the first winding operation by a counter.

Such a counter of the reversible kind is in fact associated with each roller.

A computer is provided in order to store the values of m and of N for each fabric.

Furthermore, the reversible counter associated with the roller which is the winding roller gives at each moment the number n of wound turns on that roller. The number n is transmitted to the computer, as well as the electrical signal which is a measurement of the angular speed $\omega$ of the winding roller.

The thickness of the fabric, that is to say that of each turn, is equal to $$\frac{R_m - R_o}{N} = \frac{mR_o - R_o}{N} = R_o \frac{m-1}{N}$$

When n turns are wound, the radius $R_n$ of the winding roller is $$R_n = R_o\left(1 + n\frac{m-1}{N}\right).$$

To keep the centrifugal acceleration $\gamma$ constant, the computer will square the signal which is a measurement of $\omega$ and will then multiply this square by $$\left(1 + n\frac{m-1}{N}\right)$$

and compare the result with the order value, in order to control the speed of the motor in such a way that:

$$\omega^2 R_o\left(1 + n\frac{m-1}{N}\right) = \text{Constant}$$

or $R_o$ being a fixed quantity $$\omega^2\left(1 + n\frac{m+1}{N}\right) = \text{Constant}$$

According to another embodiment of the invention, making it possible to use simple electronic circuits, is one in which acceleration is controlled not as a function of the product $\omega.v$, but as a function of the sum $a.\omega+v$, a being a coefficient equal to $R_1\times\sqrt{m}$, $R_1$ being the initial radius of the winding roller 5 and m being the ratio of the final radius of this roller to its initial radius.

The signal $a.\omega$ proportional to the angular speed $\omega$ of the roller 5 is supplied by the tachometric dynamo driven by the roller 5 (the dynamo 8 in FIG. 3). This signal and that proportional to the linear speed v, supplied by the tachometric dynamo of the cylinder 7, are summed in the electronic device 9. The corresponding signal is compared at 10 with the order value K, and the resulting signal taken at 11 is transmitted to the control device of the motor.

Figure 4:
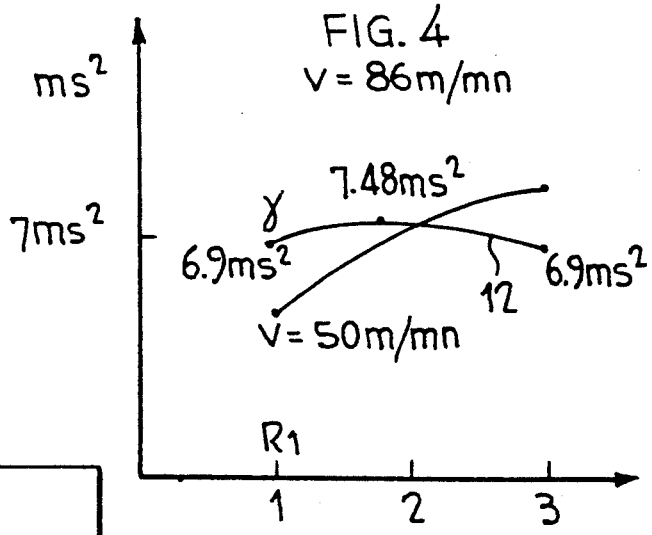
FIGS. 4 and 5 illustrate the results obtained.
Figure 5:
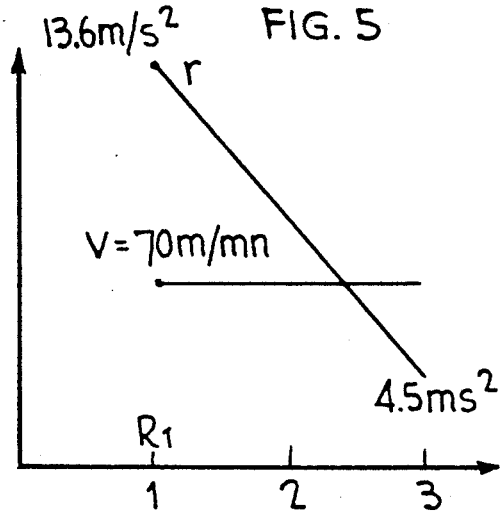

The graphs of FIGS. 4 and 5 were plotted on the basis of the numerical example in which the radius of the winding roller 5 varies between 1 and 3. In these Figures, the radii were plotted on the abscissa and the values of the centrifugal acceleration on the ordinate.

FIG. 5 shows the substantial variation in the centrifugal acceleration for a radius of the roller 5 varying from 1 to 3 when it is desired to keep the linear speed of the fabric constant at a value which, in this example, is of the order of 70 meters per minute.

On the contrary, the graph of FIG. 4 shows by its curve 12 that the centrifugal acceleration $\gamma$, the values of which are equal for the two extreme radii (there is then $a=r_1\sqrt{3}$), varies only slightly within the interval.

The curve 12 has a maximum of 7.48 $m/s^2$ for values of 6.9 $m/s^2$ at the two extreme points.

Figure 6:
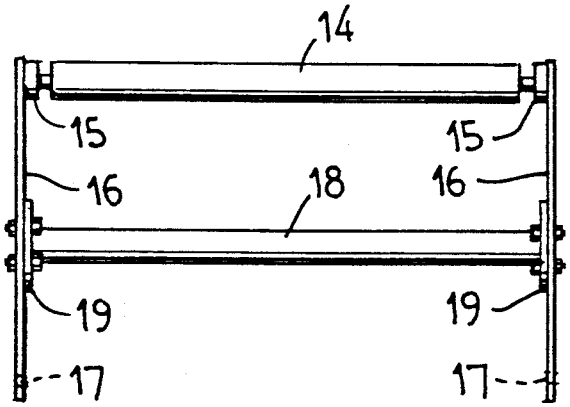
FIGS. 6 and 7 show the device for mounting the small drying cylinder in elevation and in perspective.
Figure 7:
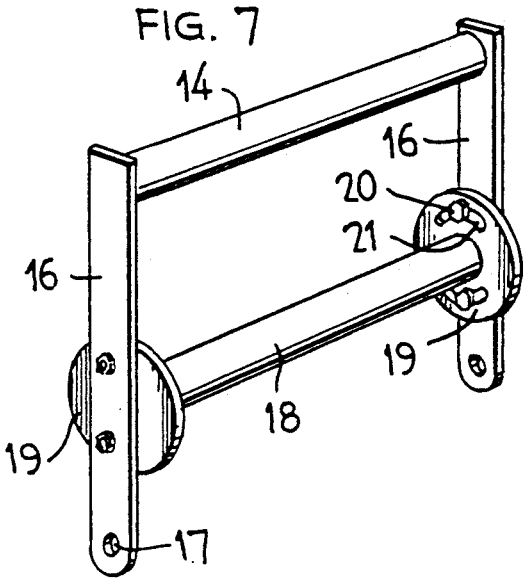

FIGS. 6 and 7 show on a larger scale, in elevation and in perspective, the small cylinder 14 which bears on the fabric at the location where it is laid onto the roller 5. This cylinder 14 which can rotate freely on its support ensures a uniform winding of the fabric coming out of the dyeing bath. The journals forming its axle are mounted freely in bearings 15 which are carried by two arms 16 mounted pivotally at 17 on the frame of the machine. The arms 16 are connected to one another by means of a spacer tube 18 equipped with flanges 19 fastened to the arms 16 by means of bolts 20. Also arranged between the flanges 19 is a rod of V-shaped cross-section, called an "expander rod", over which the fabric passes. This rod is shown at **19*a* in FIG. 1 but not in FIGS. 6 and 7**.

Because of the capacity of the arms 16 to pivot about the pivots 17, the cylinder 14 is held against the fabric winding onto the roller 5 as a result of the tension of the fabric during its passage over the expander rods or by springs or by these means combined.

It happens that, as a result of a defect of production accuracy, wear or other causes, the cylinder 14 bears on the fabric only at certain points, instead of bearing on it along a generatrix, as is necessary to obtain a uniform uptake rate of the dyeing fluid from one edge of the fabric breadth to the other.

To avoid this disadvantage, according to the invention, the assembly consisting of the arms 16 and of the spacer 18 is given some freedom of deformation. For this purpose, the embodiment illustrated provides, for the passage of the assembly bolts 20, ovalized holes 21 both on the flanges 19 and on the arms 16, and furthermore the bolts are not screwed home, the nuts being braked by means of lock nuts. Thus, the arms 16 can assume different inclinations relative to one another and in both directions, thus allowing the cylinder 14 to bear over the entire length of a regeneratrix.

It goes without saying that the embodiments described are only examples and that they could be modified, particularly by the substitution of technical equivalents, without thereby departing from the scope of the invention.

It is claimed:

1. A process for operating a machine for dyeing webs of fabric, in which the fabric to be dyed passes through a dyeing bath and then winds onto a roller, said process comprising the following steps:

a) monitoring the instantaneous angular speed $\omega$ of the winding roller during the operation of the machine, b) monitoring the linear speed of movement v of the fabric, c) forming the multiplication product $\omega.v$, d) adjusting the speed of rotation of the winding roller so as to maintain constant or substantially constant the product $\omega.v$.

2. A process for operating a machine for dyeing webs of fabric, in which the fabric to be dyed passes through a dyeing bath and then winds onto a roller, said process comprising the following steps:

a) generating an electrical signal proportional to the angular speed $\omega$ of the winding roller, b) generating a second electrical signal proportional to the linear speed of movement v of the fabric, c) forming electronically a signal proportional to the product $\omega.v$, d) adjusting the speed of rotation of the winding roller so as to maintain constant or substantially constant the said product $\omega.v$.

3. A process for operating a machine for dyeing webs of fabric, in which the fabric to be dyed passes through a dyeing bath and then winds onto a roller, said process comprising the following steps:

a) measuring continuously the instantaneous angular speed $\omega$ of the winding roller and calculating the product $a.\omega$, a being a constant coefficient equal to $R_o\sqrt{m}$, $R_o$ being the initial radius of the winding roller and m being the ratio of the maximum radius of said roller to its initial radius, b) measuring continuously the instantaneous linear speed of movement v of the fabric, c) forming the sum $a.\omega+v$, d) adjusting the speed of rotation of the winding roller so as to maintain constant or substantially constant the sum $a.\omega+v$.

4. A process for operating a machine for dyeing webs of fabric, in which the fabric to be dyed passes through a dyeing bath and then winds onto a roller, said process comprising the following steps:

a) generating an electrical signal proportional to the product $a.\omega$, $\omega$ being the instantaneous angular speed of the winding roller, while a is a constant coefficient equal to $R_o\sqrt{m}$, $R_o$ being the initial radius of the winding roller and m being the ratio of the maximum radius of said roller to its initial radius, b) generating a second electrical signal proportional to the instantaneous linear speed of movement v of the fabric, c) forming electronically a signal proportional to the sum $a.\omega+v$, d) adjusting the speed of rotation of the winding roller so as to maintain constant or substantially constant the sum $a.\omega+v$.

5. A process for operating a machine for dyeing webs of fabric, in which the fabric to be dyed passes through a dyeing bath and then winds onto a roller, said process comprising the following steps:

a) measuring the instantaneous angular speed $\omega$ of the winding roller during the operation of the machine, b) measuring the number n of wound turns on the winding roller during the operation of the machine, c) forming electronically the product $$\omega^2\left(1+n\frac{m-1}{N}\right)$$

in which m is the ratio of the final radius to the initial radius of the winding roller and N is the number of wound turns of the fabric at the end of winding, d) adjusting the speed of rotation of the winding roller so as to maintain constant or substantially constant the product $$\omega^2\left(1+n\frac{m-1}{N}\right).$$

6. A process for operating a machine for dyeing webs of fabric, in which the fabric to be dyed passes through a dyeing bath and then winds onto a roller, said process comprising the following steps:

a) generating an electrical signal proportional to the instantaneous angular speed $\omega$ of the winding roller during the operation of the machine, b) counting turn by turn the number n of wound turns on the winding roller, c) forming electronically the product $$\omega^2\left(1+n\frac{m-1}{N}\right)$$

in which m is the ratio of the final radius to the initial radius of the winding roller and N is the number of wound turns of the fabric at the end of winding;

d) adjusting the speed of rotation of the winding roller so as to maintain constant or substantially constant the product $$\omega^2\left(1+n\frac{m-1}{N}\right).$$

7. A machine for dyeing webs of fabric comprising a roller for receiving the fabric after passing through a dyeing bath, an electric motor for driving said roller, a device associated to said motor for adjusting its speed of rotation $\omega$, means designed to generate two electrical signals respectively proportional to the angular speed $\omega$ of the fabric winding roller and to the linear speed v of the fabric generated as a result of the rotation of this roller, and means utilizing these signals in order to supply the adjusting device of the electric motor with a control signal designed for keeping the product $\omega.v$ constant or virtually constant.

8. A machine as claimed in claim 7, comprising further, an electronic device adapted to sum the signal proportional to v and a signal $a.\omega$, a being a coefficient equal to the initial radius of the roller multiplied by the square root of the ratio of the final radius of this roller to its initial radius, means for comparing the sum signal with a nominal signal, and means for applying the positive or negative difference to the device for adjusting the driving speed of the winding roller.

9. A machine as claimed in claim 7, wherein an electric motor driving the winding roller is a direct-current motor and is associated with a thyristor-type variator for adjusting the voltage applied to it.

10. A machine as claimed in claim 7, wherein a variable-speed hydraulic transmission is provided between the winding roller and its electric motor so that the winding roller is driven by the electric motor by means of the variable-speed hydraulic transmission.

11. A machine as claimed in claim 7, comprising further, a drying cylinder adapted to bear on the fabric at the location where it is laid onto the winding roller, and an oscillating frame for carrying the said cylinder, said frame being deformable in such a way that the cylinder bears on the fabric over the entire width of the latter.

12. A machine as claimed in claim 7, comprising further, a drying cylinder adapted to bear on the fabric at the location where it is laid onto the winding roller and an oscillating frame for carrying the said cylinder, said frame including two arms and a spacer joining the said arms and connected to them by means allowing a freedom of movement between the spacer and the arms.

13. A process for operating a machine for dyeing webs of fabric, in which the fabric to be dyed passes through a dyeing bath and then winds onto a roller, said process comprising the following steps:

a) monitoring at each moment the angular speed of the winding roller $\omega$ and measuring the number n of wound turns on the winding roller, b) forming electronically the product $$R_o[1+n(m-1/N)]=R_n$$

in which $R_2$ is the initial radius of the winding roller, m is the ratio of the final radius of the winding roller to the initial radius of the winding roller, n is the number of wound turns at each moment on the winding roller, N is the number of wound turns at the end of winding on the winding roller, and $R_n$ is the radius corresponding at each moment to n wound turns on the winding roller; and c) adjusting the speed of rotation of the winding roller so as to maintain constant or substantially constant the product $\omega^2 R_n$ which represents the centrifugal acceleration.

14. A process for operating a machine for dyeing webs of fabric, in which the fabric to be dyed passes through a dyeing bath and then winds onto a roller, said process comprising monitoring the instantaneous angular speed of the winding roller during operation of the machine; and adjusting said instantaneous angular speed during said operation of the machine so as to maintain centrifugal acceleration of said roller constant or substantially constant at the point the fabric winds onto said roller.

15. A process according to claim 2 wherein the electrical signal of step a) is obtained utilizing a tachometric dynamo operatively connected to the winding roller; and the second electrical signal of step b) is obtained utilizing a second tachometric dynamo driven by the fabric.

16. A process according to claim 2 wherein step d) includes comparing the product $\omega.v$ with a predetermined constant value to determine the difference between the product $\omega.v$ and the constant value with this difference being the amount by which the speed of rotation of the winding roller is adjusted.

* * * * *